US005490773A

United States Patent [19]

Lloveras Capilla

[11] Patent Number: 5,490,773

[45] Date of Patent: Feb. 13, 1996

[54] POCKET LIGHTER

[75] Inventor: Xavier Lloveras Capilla, Barcelona, Spain

[73] Assignee: Flamagas, S.A., Barcelona, Spain

[21] Appl. No.: 227,453

[22] Filed: Apr. 14, 1994

[30] Foreign Application Priority Data

Mar. 11, 1994 [ES] Spain ..... 9400507

[51] Int. Cl.[6] ..... F23D 11/36

[52] U.S. Cl. ..... 431/153; 431/277; 431/276; 431/254

[58] Field of Search ..... 431/277, 153, 431/276, 254

[56] References Cited

U.S. PATENT DOCUMENTS 3,063,276 11/1962 Cassan ..... 431/277 X 5,066,220 11/1991 Vick ..... 431/153 X 5,197,870 3/1993 Yang ..... 431/153

5,271,731 12/1993 Hsin-Chung ..... 431/153 X

*Primary Examiner*—Larry Jones

*Attorney, Agent, or Firm*—Scully, Scott, Murphy & Presser

[57] ABSTRACT

A pocket lighter in which the spark wheel which may produce sparks on rotating in a first direction and rubbing on the pyrophoric stone, apart from being rotatable, is movable between a first position in which it is blocked from rotating in the first direction, and a second position in which it may rotate in said first direction, producing sparks directed towards the valve. The wheel is urged towards said first position when being actuated to rotate in said first direction and to pass to said second position, said wheel should first be rotated in a direction opposite to said first direction. Preferably the positions of the spark wheel are associated with the positions of the end stubs of the shaft thereof in some housings.

7 Claims, 4 Drawing Sheets

POCKET LIGHTER

DESCRIPTION

1. Field of the Invention

The invention relates to a pocket lighter comprising: a fuel reservoir; a valve for regulating the opening and closing of said reservoir and having an outlet port, which, when the lighter is in a vertical position, determines an outlet level; a pyrophoric stone; a rotatable toothed wheel, adapted to produce sparks directed towards said valve when rotating in a first direction and rubbing on said stone; spring means urging said stone against said wheel; a rotary shaft, coaxial with said wheel, and having two end stubs; and a housing for each of said end stubs.

2. Prior Art

U.S. Pat. No. 4,830,603, U.S. Pat. No. 5,090,893 and U.S. Pat. No. 5,002,482 teach safety mechanisms based on the presence of retractable components disabling the depression of the pushbutton and, therefore, the opening of the gas passage. Prior to ignition, it is necessary to actuate an extension of the retractable component, which is accessible from the outside, to place it in an enabling position. After each ignition, spring means return the retractable component to a disabling position.

U.S. Pat. No. 5,092,764 discloses a lighter in which the valve opening is prevented unless an external member is placed in a particular position prior to ignition. In this case depression of the pushbutton is not prevented, but the raising of the burner which would lead to the exit of the gas is blocked.

The above described embodiments, further to being in conflict with the small space available for housing the components required for achieving the desired function, require substantial investment in moulds, assembly machinery and facilities. They base the safety on the addition of a further action in the chain of movements leading to ignition. Before rotating the spark wheel to produce sparks and depressing the pushbutton to open the gas passage, it is necessary to actuate an external actuating means. Actuation of this means has to be easy and obvious since, otherwise, the less skilful users, even though they were adults, would be unsuccessful in their attempts. Furthermore, it is obvious that adding the need to carry out a simple operation to a known sequence does not make it too hard for a child to strike a light, bearing in mind that he may have plenty of time, that experimentation is particularly attractive to him and that if the operation may be observed, it will quickly be acquired by mimicry.

U.S. Pat. No. 4,717,335 discloses a lighter in which rotation of the spark wheel is prevented by the presence of a structure which rotates with the wheel and which, at one point of this movement, runs up against a fixed obstacle. Its efficacy is low, since it allows partial rotation of the spark wheel, during which it is possible to strike an odd spark.

In the lighter disclosed in U.S. Pat. No. 5,017,128, the obstacle is retractable by actuating external means. Therefore, it has the aforementioned drawbacks of complex manufacture, obviousness of the ignition procedure and rapid learning by mimicry.

It is an object of the invention to overcome the above mentioned drawbacks and fulfill a United States Federal Order requiring all lighters marketed as from a near-coming date to have childproof mechanisms.

SUMMARY OF THE INVENTION

The invention provides a lighter of the type described at the beginning wherein said wheel, apart from being rotatable, may be moved between at least a first position in which it is blocked from rotating in said first direction, said wheel being urged towards said first position when being actuated to rotate in said first direction, and a second position in which it is adapted to rotate in said first direction and produce sparks directed towards said valve; it being necessary, in order to pass from said first position to said second position, to apply to said wheel an effort other than the one with which it is caused to rotate in said first direction.

According to a preferred feature of the invention, said rotary shaft is substantially straight and said housings comprise, at least: (a) a first seat portion, said wheel being in said first position when the respective end stubs occupy said first seat portion; said stub being urged towards said safety position when said wheel is rotated in said first direction; (b) a second seat portion, said wheel being in said second position when the respective end stub occupies said second seat portion; and (c) a link portion between said first seat portion and said second seat portion, said link portions being adapted to be traversed by said end stubs.

The invention also contemplates that said housings comprise: a third seat portion, the respective end stub being in a stable position thereof when occupying this seat portion, in which it is situated when urged by said spring means; and link portions between said third seat portion and said first and second seat portions, said link portions being adapted to be traversed by said end stubs.

According to a preferred embodiment of the invention, when the lighter is in a vertical position, said third seat portion of said housing is at a height above said outlet level which is greater than the height of said first and second portions of said housing above said outlet level.

In a particularly preferred embodiment of the invention, each of said housings is of inverted V shape, forming an apex, two arms and respective ends of said arms, there being: an apex region in which said third seat portion is located; two end regions in which said first and second seat portions are respectively located; and a portion of each arm constituting said link portions.

Said blocking is due either to there being at least one shoulder in the proximity of said wheel against which the teeth of said wheel impinge when the wheel is in the said first position or by said teeth of the wheel impinging against a top edge of the pyrophoric stone, or for both reasons simultaneously.

BRIEF DESCRIPTION OF THE DRAWING

Further advantages and features of the invention will be appreciated from the following description in which, without any intention to limit, there are described preferred embodiments, with references to the accompanying drawings, in which.

DETAILED DESCRIPTION OF THE INVENTION

Figure 3:
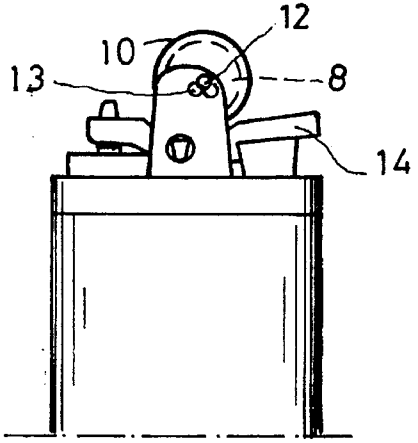
FIG. 3 is a partial side elevation view, on a smaller scale, of the lighter.

The lighter of the invention comprises a fuel reservoir 1 and a valve 2 regulating the opening and the closing of the reservoir 1. The valve 2 has an outlet port 3 which, when the lighter is in the vertical position, determines an outlet level 4, to be referred to hereinafter.

In a small container 5 there is a pyrophoric stone 6 urged by spring 7 (shown very schematically) against a wheel 8 having teeth 9 (FIGS. 5, 6, 8 and 9), which in practically all embodiments is flanked by two actuating discs 10. The wheel 8 has a rotary shaft 11 provided with two end stubs 12 located in respective housings 13.

Figure 1:
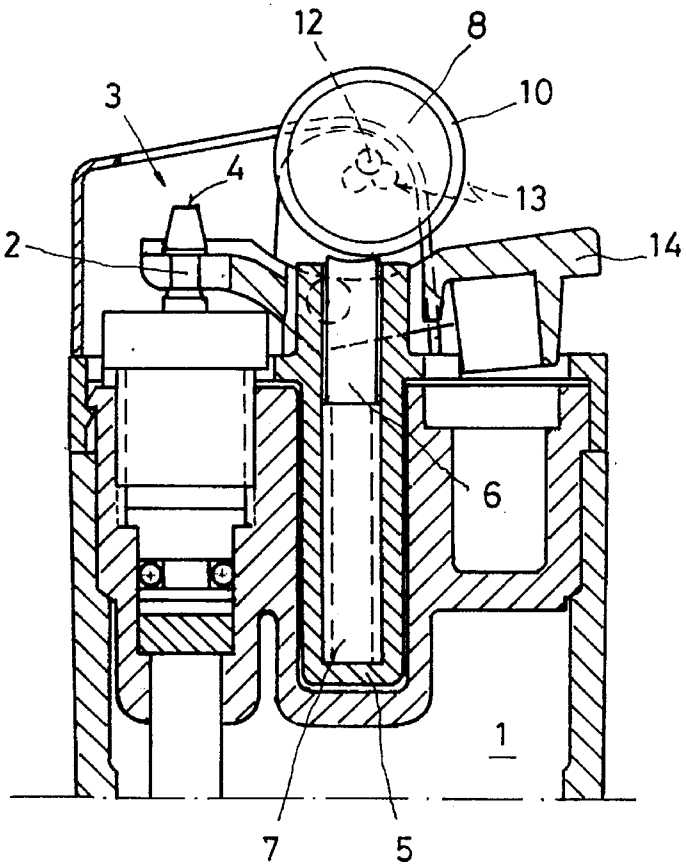
FIG. 1 is a schematic view, partly in cross section, of a lighter according to the invention, on a plane of symmetry.

In the illustrated embodiment, the valve 2 is actuated, as is usual, by the pushbutton 14, on which there is applied the user's finger 15 after causing the wheel to rotate in a first direction. In this first direction, the wheel is adapted to produce sparks directed towards the valve 2 on rubbing against the pyrophoric stone 6. This first direction in FIGS. 1 and 3 is a clockwise direction, whereas in FIGS. 5, 6 and 9 it is the direction of the arrow F.

Figure 6:
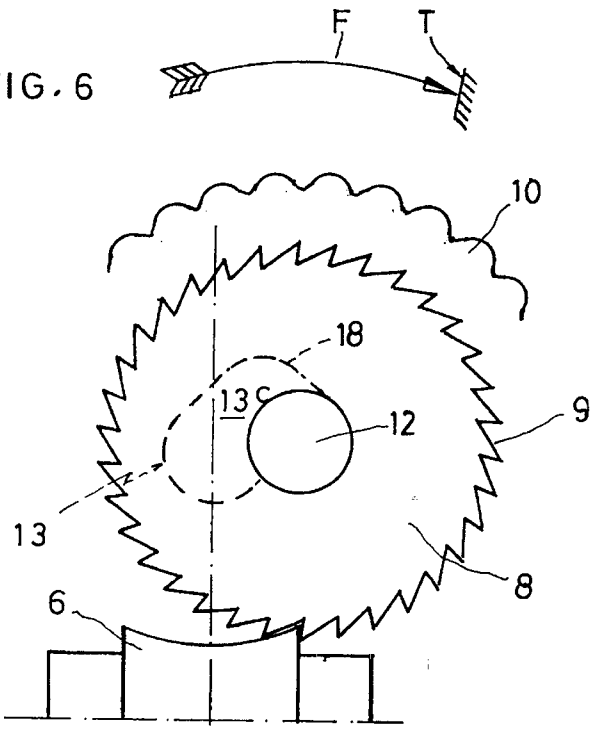
FIG. 6 is a similar view to the above in which the stub has moved into the first seat portion of the housing from the third seat portion thereof.
Figure 7:
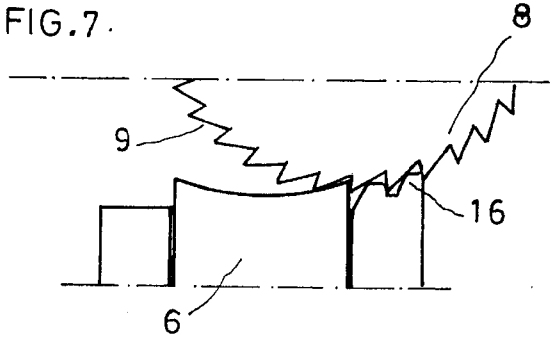
FIG. 7 is a partial view similar to the previous one in which the wheel is also blocked by a shoulder other than the pyrophoric stone.
Figure 5:
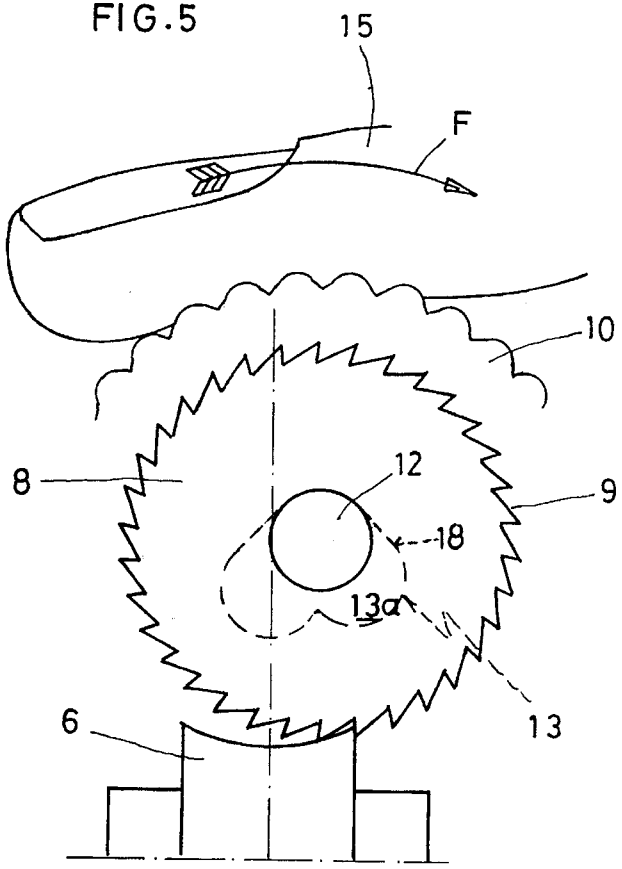
FIG. 5 is a schematic view of the toothed wheel, one of the end stubs of the rotary shaft thereof, a housing for the stub having three seat portions, a partly illustrated actuating disc and the pyrophoric stone, with the end stub occupying the third seat portion of the housing; also shown is a user's finger and an arrow showing the first directional movement of the actuating disc and of the toothed wheel; also shown schematically is the vertical center line of the pyrophoric stone so as better to appreciate the movements of the toothed wheel.
Figure 9:
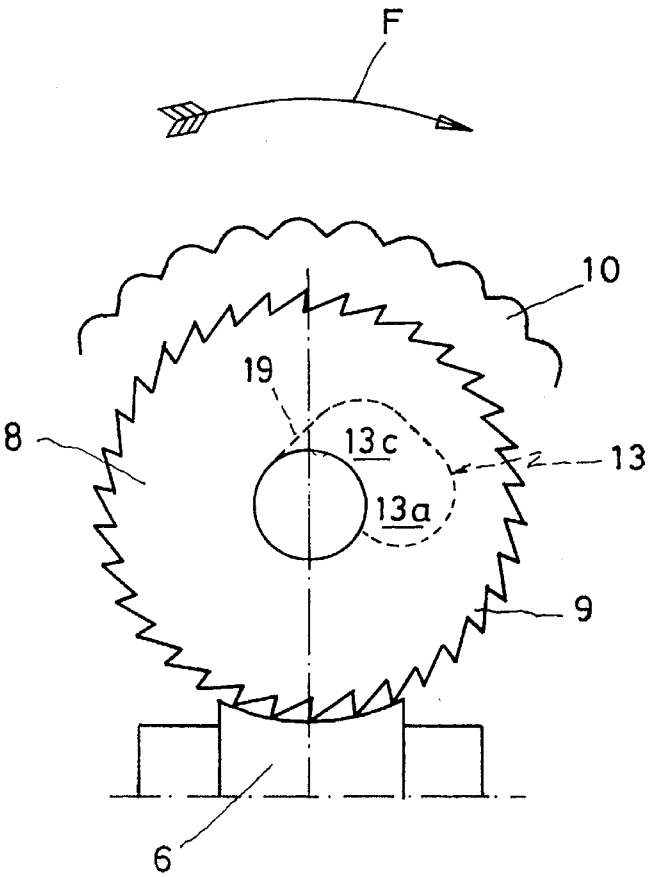
FIG. 9 is a similar view to that of FIG. 6, with the stub having entered in the second seat portion of the housing from the third seat portion thereof.
Figure 11:
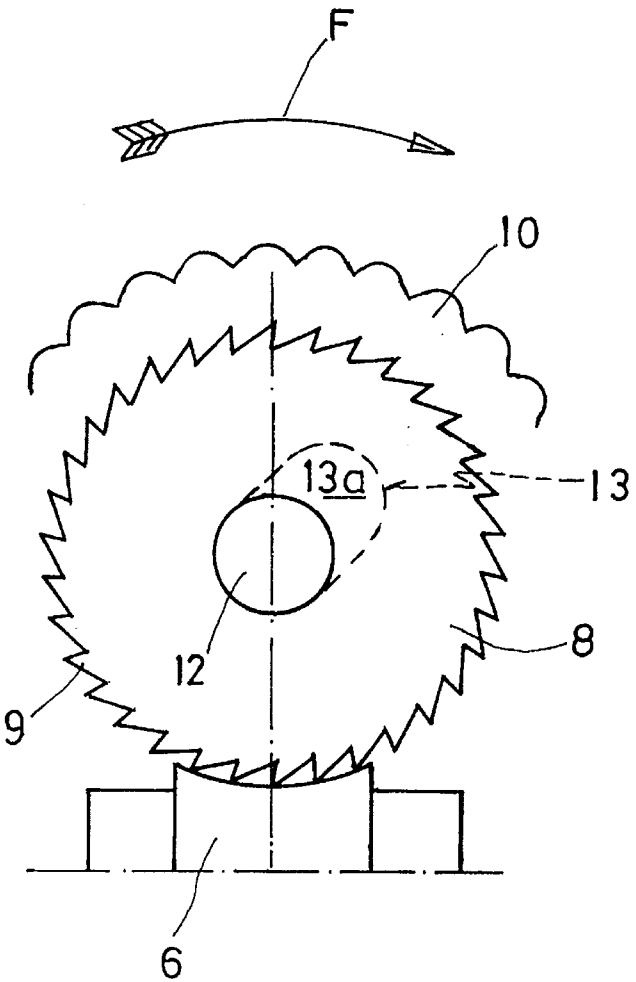
FIG. 11 is a view similar to that of FIG. 9, but also showing a housing having two seat portions.

In the lighter of the invention, further to the rotary movement with which it is of necessity provided, the wheel 8 may move at least between a first position (FIGS. 6, 7 and 10) and a second position (FIGS. 9 and 11). In the first position the rotation of the wheel 8 in said first direction is blocked. This blocking affects the teeth 9 of the wheel 8 and may be caused by the pyrophoric stone 6 (FIGS. 5, 6, 8 and 10) or also by one or more shoulders 16 (FIG. 7). In the second position, the rotation of the wheel 8 in the first direction and the production of sparks directed towards the valve 2 is not blocked.

In the embodiments shown, the different positions of the wheel are given by a special configuration of the housing 13 for the end stubs 12 of the rotary shaft of the wheel 8, said stubs 12 being aligned with the rotary shaft itself.

Figure 8:
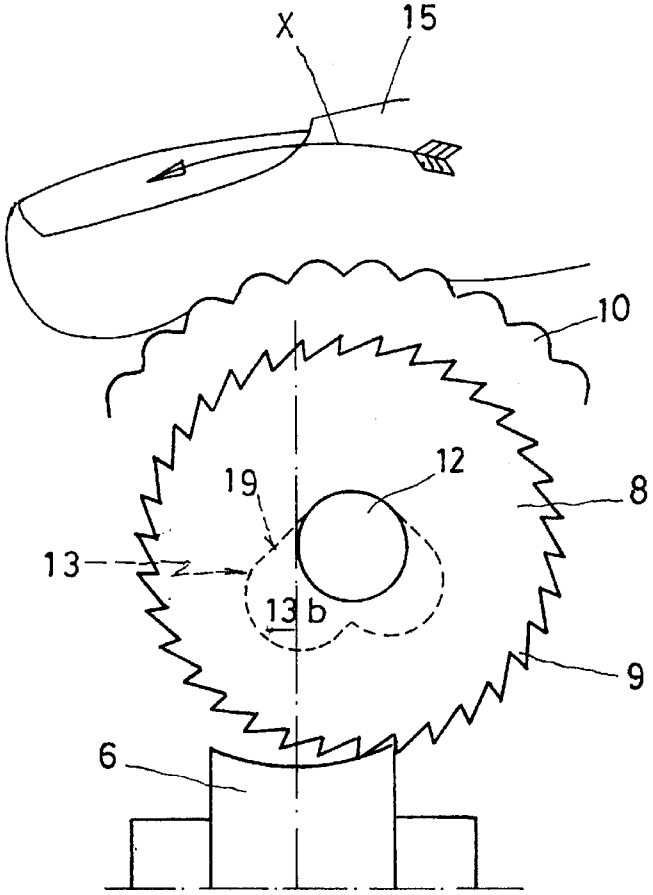
FIG. 8 is a similar view to that of FIG. 5, although the movement impressed by the user on the actuating disc and on the toothed wheel is opposite to the first direction of movement.
Figure 10:
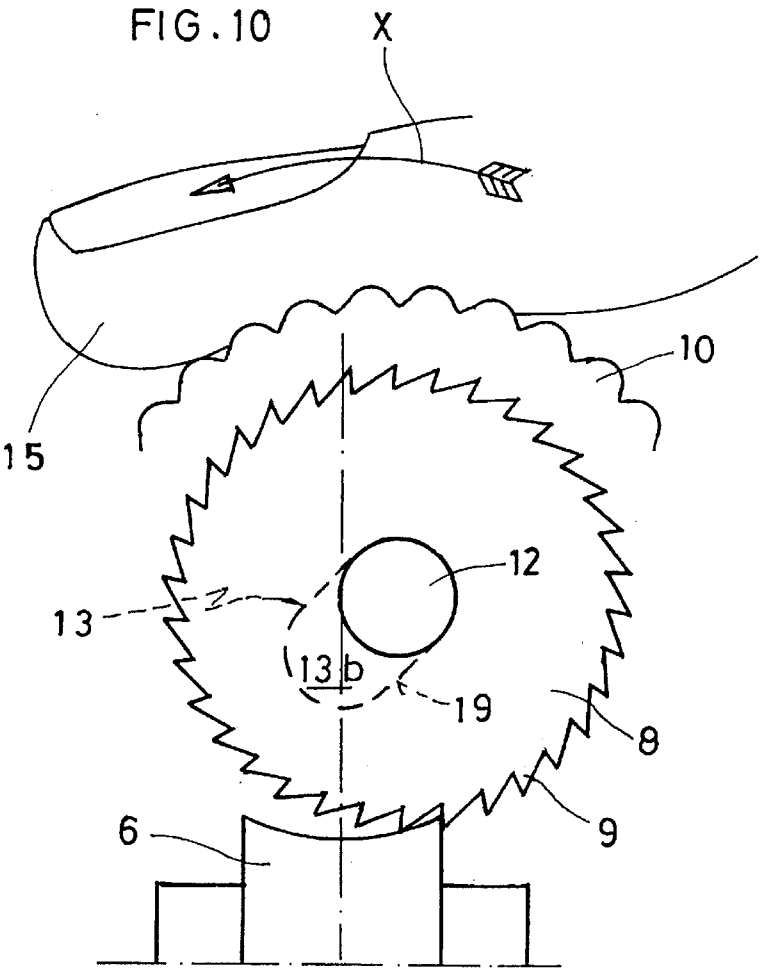
FIG. 10 is a view similar to that of FIG. 8, but showing a housing having two seat portions.

The housings 13 comprises at least one first seat portion **13*a* (marked in FIGS. 5, 9 and 11 and occupied by the end stub 12 in FIGS. 6 and 10) and a second seat portion 13*b* (marked in FIGS. 8 and 10 and occupied by the end stub 12 in FIGS. 9 and 11). The housings preferably comprise, as shown in FIGS. 5 to 9, also a third seat portion 13*c* (marked in FIGS. 6 and 9 and occupied by the end stub 12 in FIGS. 5 and 8). In the embodiment of FIGS. 10 and 11, the housings have only a first seat portion 13*a* and a second seat portion 13*b*, it being possible to say that in this case the third seat portion 13*c* coincides with the first seat portion 13*a***.

When the stub 12 is in the first seat portion **13*a* (FIGS. 6 and 10), the wheel 8 is in said first position, in which the rotation of the wheel 8 in the first direction is blocked, either by only an upper edge of the stone 6, or by shoulders 16 situated in the proximity of the wheel 8, or by both elements simultaneously. This blocking to movement in the direction of the arrow F (i.e. in the first direction) is shown in FIG. 6** by the schematic representation of a stop T.

On the contrary, when the stub 12 is in the second seat portion **13*b* (FIGS. 9 and 11), the wheel 8 is in said second position, in which its rotation in the first direction and therefore its capacity to rub against the stone 6, producing sparks directed towards the valve 2, is not blocked, In the preferred case in which each housing 13 comprises a third seat portion 13*c*, this is occupied by the stubs 12 under the free action of the spring 7, Therefore it is a stable position of the stubs 12 (FIGS. 1, 3, 4, 5 and 8) in which they are regularly located before it is intended to ignite the lighter, In such stable position (FIG. 5), when it is intended to ignite the lighter, the usual action is for the user's finger 15 to be applied to the actuating discs 10 such as to cause them and the wheel 8 to rotate in the first direction (illustrated by the arrow F), and it is obvious that this operation causes the stubs 12 to run along the link portion 18 leading them to occupy the first seat portion 13*a* of the housing 13 (FIG. 6) and therewith the wheel moves into its first blocked position (FIGS. 6 and 7), whereby the lighter may not be ignited, Nevertheless, if from the same stable position of the stubs 12 shown in FIG. 8, the user pushes the discs 10 and the wheel 8 with his finger 15 in an opposite direction (shown by the arrow X), each end stub 12 moves along a link portion 19 leading it into the second seat portion 13*b* of the housing 13 (FIG. 9), placing the wheel 8** in the second position, suitable for ignition. It remains in this position even when the wheel is thereafter rotated in the first direction of the arrow F.

As shown in FIGS. 1 and 3, when the lighter is in the vertical position, the third seat portion **13*c* of the housing 13 is at a greater height above the outlet level 4 than the seat portions 13*a* and 13*b* are above the same outlet level 4. In the preferred embodiment being described, each housing is of inverted V shape. In an area immediately adjacent the apex thereof, there is the third seat portion 13*c* and in the end areas of the arms of the V there are respectively the first seat portion 13*a* and the second seat portion 13*b***. The link portions between the said seat portions of the housing extend along the arms of the V.

Figure 4:
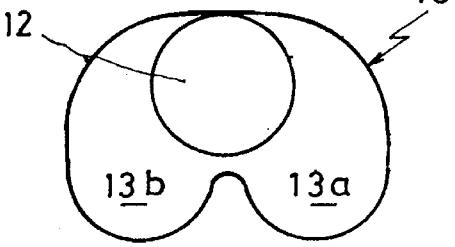
FIG. 4 is a view, on a larger scale, of a housing for an end stub of the rotary shaft of the toothed wheel.
Figure 2:
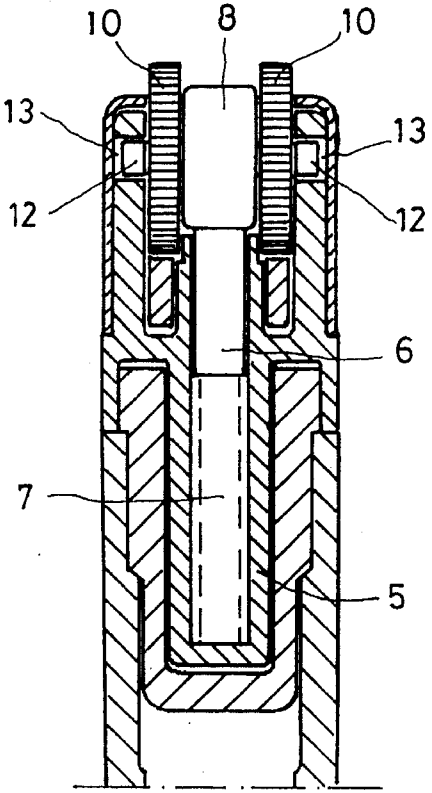
FIG. 2 is another schematic view, partly in section, on a plane perpendicular to that of the previous figure.

Another embodiment of the housing 13 is shown in FIG. 4 where the end stub 12 is in the third seat portion **13*c***.

In the embodiment of FIGS. 10 and 11, the first position **13*a* is occupied by the stubs 12 when urged by the spring 7. Therefore it is stable position of the stubs 12** in which they are regularly found before attempting to use the lighter.

In such stable position (FIG. 10), when it is intended to ignite the lighter, the regular action is for the user's finger 15 to be applied to the actuating discs 10 to cause them and the wheel 8 to rotate in the first direction (contrary to that of the arrow X shown) and it is obvious that in this way the stubs 12 will not come out of the first seat portion 13*a* of the housing 13 (FIG. 6) and therewith the wheel remains in the first blocked position thereof, whereby the lighter may not be ignited.

Nevertheless, if from the same stable position of the stubs 12 shown in FIG. 10, the user pushes the disc 10 and the wheel 8 with his finger 15 in an opposite direction (shown by the arrow X), each end stub 12 moves alone a link portion 19 leading it into the second seat portion 13*b* of the housing 13 (FIG. 11), which means that the wheel 8 is in the second position, ready for the ignition. It remains in this position even if it is subsequently caused to rotate in the first direction of the arrow F.

What I claim is:

1. A pocket lighter comprising:

a body defining a fuel reservoir for holding fuel and having open and closed positions;

a valve for regulating opening and closing of the reservoir, and having an outlet port, wherein when the lighter is in a vertical position, said outlet port defines a fuel outlet level;

a pyrophoric assembly disposed in the body and including a pyrophoric stone;

a wheel including a multitude of exterior teeth;

a rotary shaft supporting the wheel, and having first and second opposite ends;

shaft housing means connected to the body and supporting the ends of the shaft and the wheel for movement between first and second positions;

spring means supported by the body, engaging the pyrophoric assembly and urging said assembly against the wheel, wherein the pyrophoric assembly urges the wheel into the first position;

wherein, when the shaft and the wheel are in the second position, the shaft supports the wheel for rotation against the pyrophoric stone, and the wheel is rotated in a first direction to rub the teeth of the wheel against the pyrophoric stone to generate sparks and to direct the sparks toward said valve; and wherein, when the shaft and the wheel are in the first position, the pyrophoric assembly engages the wheel and blocks the wheel from rotation in the first direction; and a force in a second direction, different from the first direction, must be applied to the wheel to move the wheel from the first position to the second position.

2. The lighter of claim 1, wherein said rotary shaft is substantially straight and said housing means comprise, at least: (a) a first seat portion, said wheel being in said first position when the ends of the shaft occupy said first seat portion; the shaft and the wheel being urged towards said first position when said wheel is rotated in said first direction;

(b) a second seat portion, said wheel being in said second position when the ends of the shaft occupy said second seat portion; and (c) a link portion between said first seat portion and said second seat portion, said link portion being adapted to be traversed by said ends.

3. The lighter of claim 2, wherein said housing means comprise: a third seat portion, the ends of the shaft being in a stable position thereof when occupying this seat portion, in which it is situated when urged by said spring means; and link portions between said third seat portion and said first and second seat portions, said link portions being adapted to be traversed by said ends.

4. The lighter of claim 3, wherein when the lighter is in a vertical position, said third seat portion of said housing means is at a height above said outlet level which is greater than the height of said first and second seat portions of said housing means above said outlet level.

5. The lighter of claim 4, wherein the housing means includes first and second housings, each of said housings is of inverted V shape, forming an apex region in which said third seat portion is located; two end regions in which said first and second seat portions are respectively located; and a portion of each arm constituting said link portions.

6. A pocket lighter according to claim 1, wherein:

the pyrophoric assembly further includes a shoulder member connected to the pyrophoric stone for movement therewith; and when the shaft and the wheel are in the first position, said shoulder member engages the wheel and blocks the wheel from rotation in the first direction.

7. A pocket lighter according to claim 1, wherein:

the pyrophoric stone includes a top edge; and when the shaft and the wheel are in the first position, said top edge engages the wheel and blocks the wheel from rotation in the first direction.

* * * * *